United States Patent [19]

Weidman

[11] 3,953,564

[45] Apr. 27, 1976

[54] PROCESS FOR FORMING DECORATIVE SURFACE COVERINGS

[75] Inventor: Elvin M. Weidman, Willow Street, Pa.

[73] Assignee: Armstrong Cork Company, Lancaster, Pa.

[22] Filed: June 28, 1974

[21] Appl. No.: 483,971

[52] U.S. Cl. ..... 264/78; 264/112; 264/126; 264/245; 264/246

[51] Int. Cl.[2] ..... D01F 1/06

[58] Field of Search ..... 264/112, 73, 78, 129, 264/126, 245, 246

[56] References Cited

UNITED STATES PATENTS 3,359,352 12/1967 Powell et al. ..... 264/112;47

FOREIGN PATENTS OR APPLICATIONS 658,530 10/1951 United Kingdom

*Primary Examiner*—Robert F. White
*Assistant Examiner*—J. R. Hall

[57] ABSTRACT

A process for producing a decorative surface covering wherein granular dryblend is deposited on a releasable carrier and heated to form a porous cohesive layer. Settable resinous inks are then applied to selected surface portions of the dryblend to form design areas which may overlap at the points of application. The inked areas extend partially or completely through the layer so that they are visible from the bottom surface of the sheet which ultimately becomes the face of the surface covering, after final fusion of all of the resinous materials. The ink may optionally be set by heat prior to or simultaneously with the subsequent application and gelling of a resinous back coating, if one is used. The back coating may be reinforced by included or attached material to form a permanent carrier. Depending on the backing used, heat may be applied to fuse the composite structure before or after the release carrier is removed. Clearly defined, in-register, design areas are obtained which extend from the back of the wear layer up to or toward the wear surface of the sheet without the need for printing in register.

7 Claims, 4 Drawing Figures

PROCESS FOR FORMING DECORATIVE SURFACE COVERINGS

CROSS REFERENCE TO RELATED APPLICATIONS

Copending U.S. Pat. application Ser. No. 483,927, filed Apr. 28, 1974 is a continuation of Ser. No. 355,318, filed Apr. 30, 1973, by Frank G. Drout and Douglas R. Eyman, now abandoned. These cases relate to a refinement of this invention whereby multi-level wear surface configurations are obtained.

BACKGROUND OF THE INVENTION

1. Field of the Invention

This invention relates generally to the process for forming resinous composition surface coverings and more particularly to an "upside-down" process for forming such a product wherein a resinous dryblend layup is formed on a release carrier and heated to form a porous cohesive layer. Settable resinous inks are applied to and set within the dryblend layer to create design areas thereon which may overlap on the surface to which they are applied. The design elements may extend through the thickness of the layer from the back thereof to form a sharply defined non-overlapping wear layer design, or some of the design elements may extend only partially through the dryblend layer to create an appearance of depth in the design when viewed from the wear surface of the sheet after inversion thereof. If desired, a permanent carrier may be applied either prior to or subsequent to a final fusion of the structure and removal of the release carrier. The product is then inverted for use.

2. Description of the Prior Art

It is known to enhance the appearance of plastic floor and wall coverings by means of various decorative designs thereon which may extend partially or entirely through the sheet. It is also known to form a decorative surface covering by applying a resinous coating to a releasable carrier, decorate the coating, apply the backing and then remove the releasable carrier and invert the product for use.

One method for producing a through-grained pattern on a flexible floor covering is shown by U.S. Pat. No. 592,186 wherein granular linoleum-forming material is preconsolidated on a backing sheet at a slightly elevated temperature to form a porous mass. The partially consolidated mass is then printed by means of printing blocks or rollers so that the colored or inlaid effect penetrates to a greater or lesser extent the substance of the linoleum. The sheet is then fully consolidated by heat and pressure.

U.S. Pat. No. 3,359,352 describes depositing a layer of fine granules of resinous composition on the surface of the base, heating to sinter the granules and form a porous layer, printing a design on the sintered layer with a printing composition which will penetrate into the porous composition and then, by heat, with or without pressure, forming the printed porous layer into a non-porous layer containing an inlaid design.

Another method of forming a decorative thermoplastic resinous sheet is shown by U.S. Pat. No. 2,874,416, wherein a thin layer of thermoplastic resin is applied to a carrier sheet; a design is printed on the resinous sheet before any film strength is developed therein; a body layer of a thermoplastic resin is applied over the printed design; the layers are fused by application of heat thereto; and, the resulting decorated sheet is stripped from the carrier.

British Pat. No. 658,530 relates to a process for making decorative polyvinyl resin sheets. The process comprises printing on a support, a design in colors, each formed of a suspension of a polyvinyl resin and a pigment in one or more plasticizers. The various colors of the design flow together to form an unbroken sheet wherein the design elements extend completely through the thickness thereof.

Prior methods of forming a decorative wear surface on resinous composition surface coverings utilizing dryblend material involved printing on the surface of the dryblend layer which ultimately became the wear surface of the finished product. Because the inherent spreading of ink when printed on a dryblend is greatest at the points of application, there has existed in the prior art the problem of the need to print in register and yet obtain clearly defined design boundary lines. It has been especially difficult in the past to accomplish the foregoing where it was desired to have design elements extend clear through the thickness of the sheet, since this required that a relatively larger amount of ink be applied and therefore more spreading of the ink would occur on the surface of the sheet at the points of application resulting in overlapping and blurring of the design elements at their boundary lines. This is the problem which is solved by the process of this invention.

SUMMARY OF THE INVENTION

This invention relates to an "upside-down" process for producing a decorative wear surface on resinous composition surface covering wherein a layup of resinous dryblend is formed on a releasable carrier and heated to form a porous cohesive layer. After cooling the porous layer, a design is produced thereon by applying, preferably by printing, settable resinous inks which are subsequently set by heat. The term "upside-down" as used herein with relation to the process, means that it is a reversal of the normal process used for making this type of surface covering. The unique feature of this process is that the inks are applied to what ultimately becomes the back side of the wear surface of the surface covering, and penetrate through the dryblend layer either completely, or in predetermined varying degrees to result in a decoration which, in the finished product, extends from the backing up to or toward the side which ultimately becomes the wear surface. Overlapping of the design areas is not visible when viewed from the face of the surface covering. Thus, a sharply defined design is produced in register which extends from the back up to or toward the face of the product, without the necessity of accurate in-register printing being required. It is contemplated, of course, that the scope of the process of this invention will include any combination of the design elements which may extend entirely through or only partially through the wear surface layer.

In one embodiment of the invention, a resinous dryblend layer is heated on a release carrier to form a porous cohesive layer of the gauge desired for formation of the wear surface on the finished product. The sheet is then printed with heat settable resinous inks which penetrate completely through the thickness of the dryblend sheet. Optionally, the ink may then be heat set and an adhesive and a permanent carrier applied, or the permanent carrier (which may comprise a resinous material which may contain a blowing agent, and/or, may be reinforced by included or attached material) may be applied and the composite structure heated to set the resinous material. The sheet is then heated to fuse the resinous material and activate the blowing agent if one has been incorporated in the permanent carrier structure. The release carrier is then removed and the structure is inverted so that the surface of the material formerly in contact with the release carrier becomes the wear surface. Optionally, if a clear resinous film is deposited as a first layer on the release carrier and the remainder of the structure formed as just described, the composite structure can then be removed from the release carrier prior to fusion of all of the resinous material providing the back of the reinforcement material used is one which will not adhere to processing equipment during subsequent fusion steps.

By the process of this invention, fidelity of the printing is increased and out-of-register printing and subsequent overprinting corrections therefor are no longer a problem since, by this process, through-penetration of the ink is assured, and when the sheet is viewed from the side formerly in contact with the releasable carrier, overprinting cannot be observed. Also, by this process, in-register printing of base colors is made possible, increasing the design possibilities greatly.

Also, through utilizing the process of this invention, a foambacked product may be produced, for example, by merely adding a foamable layer of dryblend over the reinforced permanent carrier prior to the final fusion step, or by laminating a foamed backing to the printed surface. Since, by this process, the printing extends from the back to or up toward the face of the wear layer, an improved decorative wear surface is achieved and extra cost-increasing operations are eliminated. Further, by the process of this invention, there is no mixing or stirring of dryblend in plastisol and no drag on the carrier as was previously the case when most dryblend was fed into a wet base plastisol, since with "upside-down printing" the base plastisol is applied on top of the sintered dryblend.

DESCRIPTION OF THE PREFERRED EMBODIMENTS

Figure 1:
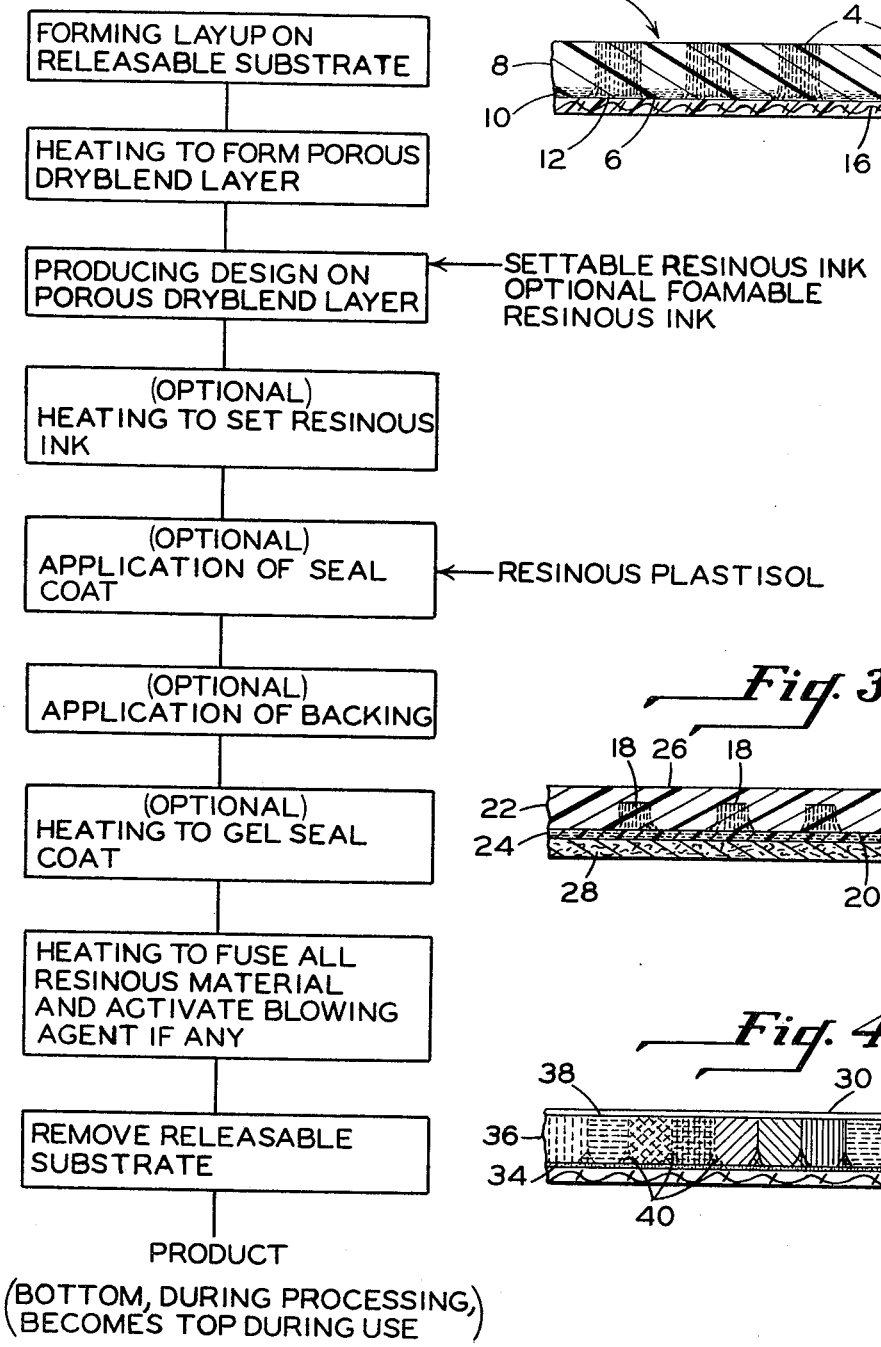
FIG. 1 is a flow diagram depicting the steps followed in carrying out the process of this invention.

As shown by the flow diagram in FIG. 1 of the drawings, the manufacturing process begins with the formation of a layer of thermoplastic resinous dryblend such as plasticized poly(vinyl chloride) on a releasable carrier of a type commonly used in the art. The dryblend layer may have a thickness in the range of from about 25 mils to 100 mils and may be formed by drawing the carrier beneath a bank of dryblend positioned in front of a screed roll mounted an appropriate distance above the carrier. The carrier may comprise an oleo-resinous-saturated felt or a beater-saturated asbestos felt, for example, which may be coated with a methylated cellulose release agent such as the reaction product of cellulose fibers and methyl chloride. Silicone release agents may also be used.

The resinous mix commonly referred to as a vnyl dryblend is in the form of a free-flowing powder which is a homogeneous mixture of unfused thermoplastic vinyl resin particles, liquid vinyl plasticizers, filler, pigment, and vinyl stabilizer.

The free-flowing mix of resin, plasticizer, stabilizer, pigment and filler may be readily formed by mixing the resin, for example a homopolymer of vinyl chloride, in the form of discrete particles, with the vinyl resin plasticizer such as di(2-ethylhexyl) phthalate, butyl benzyl phthalate, epoxidized soybean oil, or tricresyl phosphate, filler, and pigment, and suitable vinyl resin stabilizers. Mixing may be carried out in a standard mixer or blender such as a Henschel blender where the ingredients are mixed under moderate heat, for instance at a temperature of about 200°F., for a period of time to ensure that the liquid plasticizer and stabilizers become diffused throughout the resin particles, and the remaining ingredients become adsorbed thereon. Care is taken so that no fusion of the resin particles occurs during the mixing and the temperature must be kept below the point at which such fusion would occur.

Generally speaking, the addition of fillers and pigments to the mix may be made either initially; at the end of the mixing cycle when the resin particles remain relatively warm; or, after the dry-blended resin particles have been mixed and cooled. The color of the layers may be controlled over a wide range and substantially transparent or translucent layers may be achieved by omitting the filler and most or all of the pigment from the vinyl dryblend forming these layers. Based on 100 parts by weight of resin, 15 to 60 parts by weight plasticizer, 2 to 5 parts by weight stabilizer, 0 to 5 parts by weight pigment, and 0 to 25 parts by weight filler may be used in forming the powdery, freeflowing mixture.

A plastisol can be defined as a thermoplastic resin in the form of fine particles thoroughly and uniformly dispersed in plasticizer in the presence of small amounts of pigments, filler and stabilizers. A plastisol has appreciable fluidity at normal room temperatures but is converted by heat into a flexible, tough thermoplastiac mass. This ultimate result is brought about by the process of fusion wherein the resin becomes plasticized and solvated by the plasticizer.

The next step in the process following formation of the layer of dryblend on the releasable carrier involves heating the dryblend to cause partial melting of the resin granules at their points of contact, thereby forming bonds which result in formaton of a porous cohesive layer having a thickness in the range of from about 20 mils to 85 mils. Bonding of the resinous granules at their points of contact may be effected either by sintering, or through activation of a suitable external adhesive coating which may be applied in the final steps of granulation.

The next step of the invention involves the production of a design on the porous layer by the application of settable resinous inks. The term "settable" as used herein with reference to the ink is meant to include thermoplastic and thermosetting inks which may be set or gelled either by heat or chemical means. Therefore, after cooling, the porous layer may be printed with the ink in a manner and in sufficient amounts and of proper viscosities to cause penetration thereof preferably through at least about 10 percent of the thickness of the porous layer, or through the entire thickness thereof. Printing may be done, for example, by a Zimmer printer, sold by Zimmer America, Spartanberg, South Carolina. The combinations of the parts and settings of this printer may be varied to achive varying degrees of penetration of the ink into a porous surface. The inks may be colored as desired by means of dyes or pigments, or the inks may be colorless.

Optionally, sufficient heat may then be applied to gel or set the inks which then act as a bond for the dryblend to convert the printed area to a strong, coherent region. The gelling or setting of the ink is accomplished at a temperature below the fusion temperature of the granular thermoplastic resinous material. Alternatively, the ink may be set chemically. The heating step may be delayed, however, depending on the permanent carrier (backing) to be used, until after the permanent carrier has been applied. The permanent carrier may comprise any of the backings normally used as a floor covering backing such as a beater saturated rubber-asbestos sheet, resin-bonded glass webs, bonded synthetic webs, and oleo-resinous-saturated felts. These carriers may be the only final backing or they may be supplemented with other cushioning materials, such as foams and non-woven material. If a foamable material is used as the final backing layer, foaming thereof may be accomplished while the composite structure is on the release carrier, or a releasable material may be applied to the foamable material; the original release carrier removed; and, the structure turned upside down, fused, foamed and the releasable material removed. Optionally, the permanent carrier may be coated with a plastisol base coat before application to the printed porous dryblend layer; the plastisol coating may be applied to the printed porous layer first and then the backing applied; or, the plastisol coating and backing may be applied simultaneously to the printed porous layer. In an alternate procedure, after the plastisol coating has ben applied to the printed porous dryblend layer, a glass mat is pressed into the wet plastisol prior to gelling the composite and this structure alone then constitutes the permanent carrier or backing. Optionally, the plastisol base coat may be pigmented and/or incorporate glass fibers and/or fillers such as coarse limestone or silica, along with a blowing agent or metallic particles to produce desirable visual or physical characteristics in the final product. Another feature of this invention is that the plastisol coating applied to what ultimately becomes the back of the surface covering wear layer may be multi-colored and printed in register. In addition, the permanent carrier itself may be decorated to provide additional variation in the appearance of the face of the surface covering. By this process a more clearly defined decorative wear surface is obtained in the finished product since overprinting may be deliberately used to assure coverage of the area desired but when viewed from the side that becomes the face of the finished sheet, the overprinting cannot be seen and the boundary lines of the design are sharp and clear. Following application of the permanent carrier, the composite structure may then be heated to gel the plastisol and the inks (if they were not previously gelled).

The next step in the manufacture of the surface covering of this invention is fusion of all of the resinous material, plus formation of a foam in any portions containing a blowing agent.

The visual and physical characteristics of the surface covering may be further altered by chemical means, mechanical means, or by glossy final coatings to enhance the appearance and utility thereof. For example, texturing of the walking surface may be coordinated in detail with any textured effect produced in a coated backing which has been applied to the dryblend. As previously stated, a textured appearance may be achieved by the inclusion of various filler materials in a coating applied to a backing before application to the dryblend, or by embedding distinctively colored granules in unlinked areas of a dryblend which is clear after fusion and allows the granular material to be viewed therethrough. Such colored granules should be sufficiently large to appear as individual granules and should be of a composition such that the shape of the granules is not changed by the heat of final fusion of the composite structure. For example, minerals, thermoset compounds, or thermoplastic compounds whose thermal distortion occurs above that of the other compounds may be used. Cushioning layers, applied as cellular sheets or foamed latex, may be applied to the backing on the side which will contact the floor.

Figure 2:
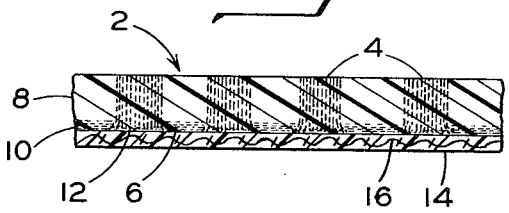
FIG. 2 is a cross-sectional view of a portion of a surface covering made by the process of this invention wherein the through-grain design elements are complmented by a partially penetrating background ink of a different color.
Figure 3:
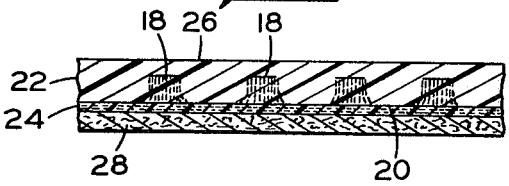
FIG. 3 is a cross-sectional view showing a portion of a surface covering wherein the ink of the design elements has partially penetrated into the clear dryblend and wherein a colored resinous base layer and nonwoven glass mat final backing have been applied over the back of the printed surface of the sheet.
Figure 4:
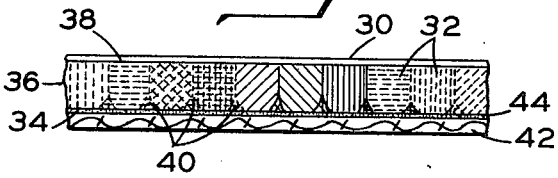
FIG. 4 is an end elevational view of a portion of a surface covering made by the process of this invention, having a clear top coat and a reinforced backing, and wherein a plurality of differently colored inks which penetrate completely through the thickness of the sintered dryblend layer are printed in side-by-side overlapping relation from the back of the layer.

FIGS. 2, 3, and 4 illustrate portions of surface coverings made by the process of this invention as they would appear when invented for use.

As shown in FIG. 2 of the drawings, a product which may be produced through the use of the process of this invention is a surface covering having a smooth decorative wear surface 2 wherein the fused colored ink-containing portions 4 extend from the back surface 6 of the fused dryblend layer 8 through the thickness thereof to the top of wear surface 2. Numeral 10 indicates the part of dryblend layer 8 penetrated by the ink used for the background color. Similarly, numeral 12 indicates the slight portion of previously inked portions 4 penetrated by the background ink which was applied in an overall manner to the back surface 6 of the printed dryblend layer 8. Numeral 14 indicates a resinous backing having a reinforcing material 16 therein. FIG. 3 illustrates a section of smooth-surfaced floor covering made by the process of this invention wherein the fused inked portions 18 extend from the back surface 20 of fused clear dryblend layer 22 partially through the thickness thereof. A differently colored resinous base layer 24 is provided on the back surface 20 of the dryblend layer 22 whereby a decorative contrast and depth effect is provided when the floor covering is viewed from a point above the wear surface 26. A final backing material such as a non-woven glass mat 28 is attached to resinous base layer 24 by applying the glass mat 28 to the base layer 24 while it is still wet. FIG. 4 of the drawings illustrates another embodiment of the process of this invention wherein there is shown an end elevational view of a portion of a surface covering having a clear resinous top coat 30 and a plurality of differently colored linked design areas 32. The clear top coat 30 may be formed by depositing and gelling a clear plastisol layer on a release carier as a first step in the process prior to application of a dryblend layer which is subsequently printed and fused. A clear resinous top coat may also be applied just prior to the final fusion of all resinous material in the composite structure by providing a second release carrier on the back (the surface to which the ink is applied) of the unfused, printed porous dryblend layer; removing the first release carrier from what ultimately becomes the face of the material; turning the printed sheet over; applying a clear plastisol and then fusing all of the resinous material. Optionally, the clear top coating may be applied by known methods after final fusion of the resinous material in the previously formed composite structure. The inked areas 32 are printed in side-by-side overlapping relationship on the back surface 34 of the dryblend layer 36 and extend from the back surface 34 entirely through the thickness of dryblend layer 36 to the top surface 38 thereof. Overlapping areas 40 of the inked areas 32 are not visible when the sheet is viewed from above when it is inverted for use. A reinforced resinous backing layer 42 is shown attached to the back surface 34 of the dryblend layer by a key coat 44.

Products which can be manufactured within the scope of this invention may include but are not limited to, floor coverings, wall coverings, drapery and upholstery materials, and furniture components. Both flexible and rigid sheet products may be manufactured by the process of this invention. In the smooth surfaced products by the process of this invention, the printed patterns are sharp and clear and may extend partially or completely through the sheet toward the wear surface from the backing.

The following examples are given for purposes of illustration:

EXAMPLE I

Dryblend granules were prepared by mixing the following components together in a Henschel dryblending apparatus through a heat history from ambient conditions to 220°F. to ambient conditions.

| | Parts |
|---|---|
| Poly(vinyl chloride) | 100.00 |
| Di-(2-ethylhexyl) phthalate | 25.00 |
| Epoxy soya | 5.00 |
| Ba-Cd liquid stabilizer + phosphite Chelator | 5.00 |

The granules were deposited on a release-coated, beater saturated rubber-asbestos sheet to form a uniform layer about 60 mils thick. The sheet was then passsed through an oven in which the granules reached a temperature of about 270°–290° F. and became sintered into a porous cohesive layer about 45 mils thick.

After cooling, the sintered material was printed for clearthrough penetration in a design with a first ink having the following composition.

| | Parts |
|---|---|
| Poly(vinyl chloride) | 100.00 |
| Di-(2-ethylhexyl) phthalate | 25.12 |
| 2,2,4-trimethyl-1,3-pentanediol diisobutyrate | 16.96 |
| Organotin (stabilizer) | 2.00 |
| 50 parts titanium dioxide in 50 parts di-(2-ethylhexyl) phthalate | 10.00 |
| 17.5% phthalo cyanine green pigment in 82.5% di-(2-ethylhexyl) phthalate | 1.00 |

Previously unprinted areas of sintered material were then printed with a second ink which was clear, and penetrated completely through the sheet. The second ink had the following composition:

| | Parts |
|---|---|
| Poly(vinyl chloride) | 100.00 |
| Di-(2-ethylhexyl) phthalate | 15.00 |
| 2,2,4-trimethyl-1,3-pentanediol diisobutyrate | 20.00 |
| Octyl epoxy tallate | 5.00 |
| Polyethylene glycol monolaurate | 2.00 |
| Barium cadmium zinc organic compound stabilizer | 3.50 |

A third, differently colored ink was applied in an overall manner to the previously printed, sintered sheet and penetrated partially thereinto thereby providing a contrasting background color in the areas printed previously with the second, clear ink. The third ink had the following composition:

| | Parts |
|---|---|
| Poly(vinyl chloride) | 100.00 |
| Di-(2-ethylhexyl) phthalate | 20.00 |
| 2,2,4-trimethyl-1,3 pentanediol diisobutyrate | 10.00 |
| Organotin (stabilizer) | 2.00 |
| 50 parts titanium dioxide in 50 parts di-(2-ethylhexyl) phthalate | 8.00 |

About 8 to 10 mils of an adhesive plastisol having the following composition was then applied to the printed, sintered dryblend:

| | Parts |
|---|---|
| Poly(vinyl chloride) | 100.00 |
| Di-(2-ethylhexyl) phthalate | 32.00 |
| 2,2,4-trimethyl-1,3 pentanediol diisobutyrate | 82.00 |
| Modified tin maleate (stabilizer) | 2.00 |
| Silicon dioxide | 8.00 |

A glass mat was then pressed into the wet adhesive plastisol. The composite sheet was heated in an oven to a temperature of about 440°F. to fuse all of the resinous material, cooled, and removed from release carrier. A smooth wear surface was obtained on the surface covering having clearly defined decorations which extended completely through the wear surface from the backing, together with a partially penetrated, decorative background color.

EXAMPLE II

A sintered dryblend sheet was formed on a release carrier as in Example I. The cooled, sintered sheet was then printed in a design using the same ink used in printing the design on the sheet of Example I, except that a print screen with smaller mesh size was used together with less pressure on the squeegee bar. This resulted in deposition of less ink on the sintered porous layer and only partial penetration of the ink through the thickness of the sheet. About 8 to 10 mils of a plastisol having the following composition was then applied to the printed, sintered dryblend:

| | Parts |
|---|---|
| Poly(vinyl chloride) | 100.00 |
| Cresyl diphenyl phosphate | 65.00 |
| 2,2,4-trimethyl-1,3 pentanediol diisobutyrate | 20.00 |
| Organotin stabilizer | 2.00 |
| Silicon dioxide (particle size .012 microns) | 12.00 |
| 50 parts titanium dioxide in 50 parts di-(2-ethylhexyl) phthalate | 5.00 |

The release-coated sheet carrying the printed, plastisol-coated, sintered sheet was then heated in an oven for one to two minutes to a surface temperature of about 200°–220° F. to gel the printing composition and the plastisol coating. A 10–15 mil film of the following formulation was applied in an overall coating onto the gelled plastisol to serve as an adhesive between the gelled plastisol and a permanent backing.

| | Parts |
|---|---|
| Poly(vinyl chloride) | 100.00 |
| Di-(2-ethylhexyl) phthalate | 25.12 |
| 2,2,4-trimethyl-1,3 pentanediol diisobutyrate | 16.96 |
| Organotin (stabilizer) | 2.00 |
| 50 parts titanium dioxide in 50 parts di-(2-ethylhexyl) phthalate | 10.00 |

A non-woven glass mat backing was applied, the adhesive set and the composite structure was taken off the release carrier. The composite sheet was heated in an oven to a temperature of about 440° F. to fuse all of the resinous material. A smooth-surfaced surface covering was obtained which had a decorative design with an appearance of depth when viewed from the face downwardly through the clear, fused dryblend.

EXAMPLE III

About an 8 to 10 mil coating of clear plastisol was formed and gelled on a release-coated, beater saturated rubber-asbestos sheet. About 40 mils of the same dryblend granules as those used in Example I were deposited onto the gelled plastisol and sintered in an oven at about 270°–290° F. After cooling, an overall decorative design was formed on the sintered sheet by printing thereon with differently colored inks in side-by-side overlapping relationship. A 100 percent penetration of the inks through the entire thickness of the sintered dryblend layer was achieved by overprinting as necessary with inks having the following composition:

| | Parts |
|---|---|
| Poly(vinyl chloride) | 100.00 |
| Di-(2-ethylhexyl) phthalate | 25.12 |
| 2,2,4-trimethyl-1,3 pentanediol diisobutyrate | 16.96 |
| Organotin (stabilizer) | 2.00 |
| 50 parts titanium dioxide in 50 parts di-(2-ethylhexyl) phthalate | 10.00 |
| Pigment in 82.5% di-(2-ethylhexyl) phthalate | 1.00 |

About 10–15 mils of an adhesive plastisol having the following composition was applied to the printed, sintered dryblend as an overall coating:

| | Parts |
|---|---|
| Poly(vinyl chloride) | 100.00 |
| Di-(2-ethylhexyl) phthalate | 32.00 |
| 2,2,4-trimethyl-1,3 pentanediol diisobutyrate | 82.00 |
| Modified tin maleate | 2.00 |
| Silicon dioxide | 8.00 |

A glass mat was then pressed into the wet plastisol and the sheet was then heated in an oven for one to two minutes to a surface temperature of 200°–220° F. to gel the plastisol. The release carrier was then removed and the composite sheet was heated in an oven to a temperature of about 440° F. to fuse all the resinous material. A clear-coated surface covering having sharply defined decorative design portions which extended from the backing upwardly and completely through the fused dryblend layer was obtained.

What is claimed is:

1. A process for producing a thermoplastic resinous decorative surface covering, comprising:

a. depositing a layer of unfused thermoplastic granules of a resinous dryblend onto a releasable substrate, b. heating said layer to cause partial melting of at least surface portions of the granules at their points of contact, c. cooling and thereby bonding adjacent granules to form a cohesive, porous layer having an upper and a lower surface, d. applying in a design to the upper surface of said layer, an amount of a first colored settable resinous ink having a viscosity sufficient to at least partially penetrate said porous layer, e. applying at least one additional settable resinous ink to the upper surface of said porous layer to cover at least portions of the design formed by the first applied ink, and also at least portions of the upper surface of the porous layer not covered by the first applied ink, said additional ink having a different color than that of said first ink, said inks being applied to penetrate into said porous layer in sufficient amounts so that the ink design is visible from the lower surface thereof after final fusion of all resinous material in said layer, f. heating said layer for final fusion of all resinous material in the ink-containing porous layer to form a non-porous sheet, g. cooling said fused sheet, and h. removing said substrate whereby there is formed a surface covering having a clearly defined in-register, multi-colored, decorative design visible from said lower surface of said sheet, which in use becomes the upper surface of said covering.

2. The process accordng to claim 1 wherein the dryblend is transparent after final fusion and wherein the additional settable resinous ink is applied in amounts and viscosities sufficient to result in penetration thereof through the porous layer to degrees different from the degree of penetration of said first-applied settable resinous ink, whereby an in-register, multi-color, multi-level design is achieved in the surface covering.

3. The process according to claim 1 wherein at least one of said settable resinous inks is applied in an amount and viscosities sufficient to result in penetration thereof through substantially the entire thickness of the porous dryblend layer.

4. The process according to claim 1 wherein the additional settable resinous ink comprises a plurality of differently colored inks applied in side-by-side overlapping relationship with each other and with said first-applied ink, all of said inks being applied onto the porous dryblend layer in amounts and viscosities sufficient to result in penetration through substantially the entire thickness of the layer, whereby a multi-colored, clearly defined design is achieved with no overlapping of the differently colored inks in the design being visible from the upper surface of the surface covering.

5. The process according to claim 1 wherein the granules of the resinous dryblend have an adhesive coating.

6. The process according to claim 1 wherein the resin in the dryblend granules is vinyl resin, the layer of unfused resinous granules has a thickness in the range of from about 25 mils to 100 mils, and wherein the dryblend layer is formed into a cohesive porous layer having a thickness in the range of about 20 mils to 85 mils by heating to a temperature in the range of about 270°F. to 290°F.

7. The process according to claim 6 wherein the resin in the dryblend granules is poly(vinyl chloride).

* * * * *